United States Patent [19]

Caminiti

[11] Patent Number: 4,829,988

[45] Date of Patent: May 16, 1989

[54] TENDON DEPRESSOR

[76] Inventor: Pietro S. Caminiti, 25081 Oro Valley Rd., Auburn, Calif. 95603

[21] Appl. No.: 883,355

[22] Filed: Jul. 8, 1986

[51] Int. Cl.[4] ..... H61F 5/00

[52] U.S. Cl. ..... 128/69; 128/67

[58] Field of Search ..... 128/67, 740, 744, 15, 128/26, 54, 303 R; 84/320, 322; 2/160, 163, 21; 223/101

[56] References Cited

U.S. PATENT DOCUMENTS

| | | | |
|---|---|---|---|
| 668,823 | 2/1901 | Pillins | 128/15 |
| 1,478,388 | 12/1923 | Gray | 128/54 |
| 1,951,190 | 3/1934 | Gambee | 2/21 |
| 2,547,243 | 4/1951 | Amer | 128/67 |
| 4,483,328 | 11/1984 | Wolocko | 128/67 |

*Primary Examiner*—Edgar S. Burr
*Assistant Examiner*—Kimberly L. Asher

[57] ABSTRACT

The tendon depressor is a tool that is designed to be used while eliciting deep tendon reflexes. A first embodiment of the depressor may be worn on a user's thumb, while the second embodiment may be worn on an index finger. Each embodiment includes a top portion made out of rigid plastic, with a thin layer of soft sponge being provided on a bottom surface of the plastic. A thin, elastic rubber material is connected beneath the sponge portion and serves to receive the user's thumb or finger. The tendon depressor is designed to create a more comfortable and accurate clinical procedure to elicit certain tendon reflexes, such as the biceps brachii, biceps femoris, semitendinosus, semimembranosus, pectoralis and suprapatellar reflexes.

10 Claims, 1 Drawing Sheet

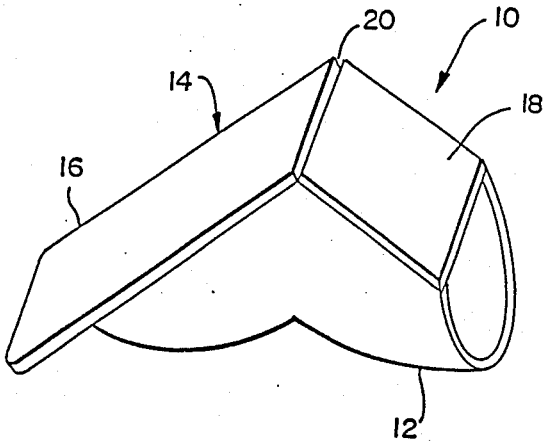
FIG. 1
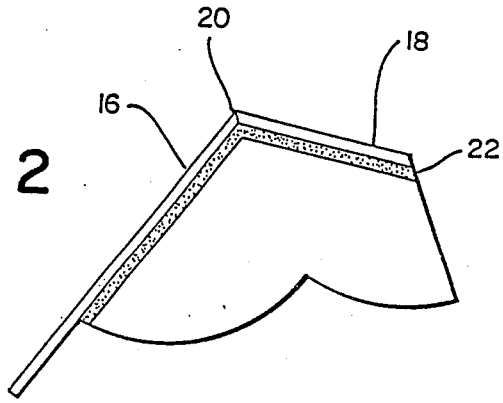
FIG. 2
FIG. 3
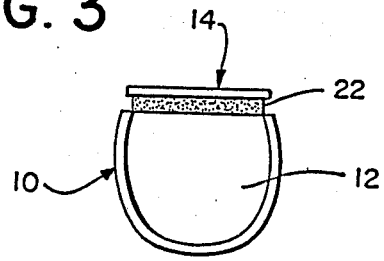
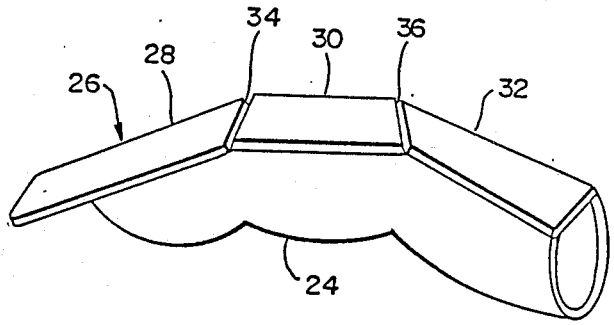
FIG. 4

TENDON DEPRESSOR

BACKGROUND OF THE INVENTION

1. Field of the Invention

The present invention relates to implements adapted for the use by a therapist or the like, and more particularly pertains to a new and improved tool for eliciting deep tendon reflexes.

2. Description of the Prior Art

The use of various medical implements by doctors, therapists, chiropractors, and the like, to reduce the effort required for patient therapy and treatment is well known in the art. For example, a number of such implements have been devised which are designed to reduce the effort in those cases where fingers, thumbs or knuckles are pressed against a patient's body to thereby reduce the problem of therapist injury and effectiveness. For example, U.S. Pat. No. 4,483,328 which issued to R. Wolocko on Nov. 20, 1984, discloses a chiropractic instrument for applying therapeutic pressure. More specifically, the Wolocko device consists of a one-piece integral structure having a planar star-like configuration which includes three legs radiating from a central hub and adapted to be grasped and used in various orientations to simulate thumb, knuckle and finger pressure on a patient's body. However, the Wolocko implement is limited to its uses, and by its design, it would not be suitable as a tendon depressor.

Inasmuch as standard medical practice usually includes tendon reflex tests, it can be appreciated that there exists a need for instruments which make tendon reflex testing easier, while preventing injury to the therapists conducting the tests. In this regard, medical personnel frequently injure themselves with the instruments required for conducting tendon reflex tests, e.g., quite frequently a reflex hammer used to conduct a test will strike the therapist's hand, etc. As such, there exists a continuing need for new and improved instruments which will permit such tendon reflex testing without the danger of injury to a therapist, and in this respect, the present inventio substantially fulfills this need.

SUMMARY OF THE INVENTION

In view of the foregoing disadvantages inherent in the known types of chiropractic instruments now present in the prior art, the present invention provides as improved chiropractic instrument wherein the same can be utilized for tendon reflex testing in a more efficient manner while reducing the chance of injury to the person conducting such tests. As such, the general purpose of the present invention, which will be described subsequently in greater detail, is to provide new and improved chiropractic instruments which have all the advantages of the prior art chiropractic instruments and none of the disadvantages.

To attain this, the present invention defines a device which is shaped to conformingly fit over the thumb or index finger of a user. The top of the device is formed from a place of angulated rigid plastic with a thumb or finger holder formed from flexible rubber being attached thereto. A thin layer of soft sponge rubber separates the flexible finger or thumb holder from the plastic member. The tool serves to protect the finger or thumb of the user while presenting a rigid surface, i.e., the rigid plastic member, for striking with a reflex hammer to elicit the deep tendon reflex.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended thereto. Those skilled in the art will appreciate that the conception, upon which the disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved chiropractic instrument which has all the advantages of the prior art chiropractic instruments and none of the disadvantages.

It is another object of the present invention to provide a new and improved chiropractic instrument which may be easily and efficiently manufactured and marketed.

It is a further object of the present invention to provide a new and improved chiropractic instrument which is of a durable and reliable construction.

An even further object of the present invention is to provide a new and improved chiropractic instrument which is susceptible of a low cost of manufacture with regard to both materials and labor, and which accordingly is then susceptible of low prices of sale to the consuming public, thereby making such chiropractic instruments economically available to the buying public.

Still yet another object of the present invention is to provide a new and improved chiropractic instrument which provides in the apparatuses and methods of the prior art some of the advantages thereof, while simultaneously overcoming some of the disadvantages normally associated therewith.

Still another object of the present invention is to provide a new and improved chiropractic instrument designed to elicit deep tendon reflexes.

Yet another object of the present invention is to provide a new and improved chiropractic instrument which may be efficiently utilized to elicit tendon reflexes while protecting the thumb or finger of a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a first embodiment of the tendon depressor comprising the present invention.

FIG. 2 is a side elevation view thereof.

FIG. 3 is a rear elevation view of the invention.

FIG. 4 is a perspective view of a modified embodiment of the invention.

DESCRIPTION OF THE PREFERRED EMBODIMENT

With reference now to the drawings, and in particular to FIG. 1 thereof, a first embodiment of a new and improved tendon depressor embodying the principles and concepts of the present invention and generally designated by reference numeral 10 will be described.

More specifically, it will be noted that the first embodiment of the tendon depressor 10 includes a hollow holding portion 12 which is formed of a thin, durable rubber designed to elastically and conformingly fit over a user's thumb, with an angulated rigid plastic member 14 being attached to a top portion thereof. In this connection, the plastic member 14 is formed of two separate flat plastic sections 16, 18 fixedly or otherwise secured together along an edge 20. The edge 20 may constitute an integral interconnection between the sections 16, 18 or alternatively, it can effectively function as a hinge to permit relative pivotal movement between the two sections. The hinge edge 20 could still be of an integral design whereby a flexing of the plastic is permitted to effect a hinge action, or a separable hinge of some known design and construction could be utilized. Accordingly, it is within the intent and purview of the present invention to utilize any known connection means, to include all conceivable hinge structures, to effect a connection of the sections 16, 18.

Referencing FIGS. 2 and 3 of the drawings, it will be noted that the angulated plastic member 14 may be attached to the thumb holding section 12 by a thin layer of sponge rubber 22. In this respect, the sponge rubber 22 is sealingly attached between the plastic member 14 and the thumb holding section 12 by some conventional means, such as through the use of rubber cement or the like, and may constitute a top wall portion of the thumb section 12. Alternatively, the thumb holding member 12 could be of a continuous wall construction so as to totally encapsulate a user's thumb, with the sponge rubber section 22 then being glued to a top section of the thumb holding member.

FIG. 4 of the drawings illustrates a modified embodiment of the invention wherein the same includes an index finger holding portion 25 which is also formed of a thin durable elastic rubber and which is shaped to conformingly fit a slightly bent index finger. Attached to a top section of the index finger holding portion is an angulated plastic member 26 comprised of three interconnected sections 28, 30, 32. The members 28, 30 are interconnected along an edge 34, while the members 30, 32 are interconnected along an edge 36. If desired, a flexible connection can be permitted as with the first embodiment of the invention whereby the edges 34, 36 function as hinge sections to facilitate flexural movement of the second embodiment of the invention. As with the first embodiment of the invention, a thin layer of sponge rubber 22 separates the angulated member 26 from the index finger holding portion 24.

With respect to the manner of usage of the present invention, a doctor may utilize either form of the invention by placing the preferred form on his thumb or index finger. The doctor then palpates the tendon desired, and two techniques are available to achieve tendon reflex response. In a first technique, the invention 10 is allowed to slide off to the side of the tendon while being maintained in contact therewith through the bottom rubber part of the tool at the tip of the thumb or finger. While maintaining a contact point with the tendon, the doctor then depresses the extended plastic portion 16 or 28 over the tendon. The depressor 10 is then firmly struck with a reflex hammer or the like to elicit the deep tendon reflex.

The second technique requires the doctor to palpate the desired tendon through the rubber portion of the tendon depressor 10 with the palmer surface of the thumb or index finger at the distal phalange. The difference in this second technique is to keep the contact point with the tendon at the palmer surface of the thumb or index finger without sliding to the side of the tendon. The tendon depressor 10 may then be struck to elicit the deep tendon reflex.

As can be appreciated, the present invention provides advantages not presently available in the prior art. for example, a doctor can strike the tendon depressor 10 with greater force without the discomfort of striking his thumb or index finger with the reflex hammer. In this regard, the tendon depressor 10 offers a flat surface, instead of a convoluted surface like that of the thumb and index finger, and further offers a larger target surface area which reduces the likelihood of completely missing the desired strike point. As such, the invention offers a more comfortable and more accurate way of eliciting certain deep tendon reflexes whereby the doctor can palpate the tendon desired and, at the same time, feel the tendon move when the muscle contracts during the deep tendon reflex.

With respect to the above description then, it is to realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters Patent of the United States is as follows:

1. A tendon depressor to be used in conjunction with a reflex hammer, comprising:

a. thumb engaging means to fit onto the thumb of a hand of a user of said tendon depressor; and, b. a rigid planar member secured to said thumb engaging means and extending over at least a portion of the dorsal surface a thumb, and outwardly beyond the tip of a thumb, said rigid planar member extending over at most said dorsal surface of a thumb, said rigid planar member having a lower surface attached to said thumb engaging means, said rigid planar member having further an upper striking surface for receiving a blow from said reflex hammer said striking surface being outward of a tip of a thumb.

2. The tendon depressor of claim 1, wherein said outwardly extending portion further has a flat lower surface, said outwardly extending portion extending sufficiently far beyond said tip of a thumb to allow said lower surface of said outwardly extending portion to be placed over a tendon without the interposition of a thumb.

3. The tendon depressor of claim 2 and further including a cushioning means positioned between said lower surface of said rigid planar member and said thumb engaging means, said cushioning means serving to cushion a thumb from a blow from said reflex hammer.

4. The tendon depressor of claim 3, wherein said thumb engaging means comprises a flexible member, said member fitting conformably over at least a portion of a thumb.

5. The tendon depressor of claim 4, wherein said rigid planar member includes two planar sections hingedly interconnected, said hinged interconnections allowing for flexion and extension of the joints of a thumb.

6. A tendon depressor to be used in conjunction with a reflex hammer, comprising:

a. index finger engaging means to fit onto the index finger of a hand of a user of said tendon depressor; and, b. a rigid planar member secured to said finger engaging means and extending over at least a portion of the dorsal surface of an index finger, said rigid planar member extending over at most said dorsal surface of an index finger, said rigid planar member having a lower surface attached to said index finger engaging means, said rigid planar member having further an upper striking surface for receiving a blow from said reflex hammer said striking surface being outward of a tip of an index finger.

7. The tendon depressor of claim 6, wherein member includes a portion extending outwardly beyond the tip of a index finger, said outwardly extending portion having an upper striking an index outwardly extending portion having further a flat lower surface, said outwardly extending portion extending sufficiently far beyond said tip of an index finger to allow said lower surface of said outwardly extending portion to be placed over a tendon without the interposition of an index finger.

8. The tendon depressor of claim 7 wherein said index finger engaging means comprises a flexible member, said member fitting conformably over at least a portion of a index finger.

9. The tendon depressor of claim 8 and further including a cushioning means positioned between said lower surface of said rigid planar member and said index finger engaging means, said cushioning means serving to cushion an index finger from a blow from said reflex hammer.

10. The tendon depressor of claim 9, wherein said rigid planar member includes at least two planar sections hingedly interconnected, said hinged interconnection allowing for flexion and extension of the joints of an index finger.

* * * * *